US008956001B2

(12) United States Patent
Ng et al.

(10) Patent No.: US 8,956,001 B2
(45) Date of Patent: Feb. 17, 2015

(54) CANDLE HOLDER WITH CANDLE LIGHT ACTIVATED ILLUMINATION

(71) Applicants: Kai-Kong Ng, Hong Kong (CN); Ming-Yao Chiang, Checheng Township, Pingtung County (CN)

(72) Inventors: Kai-Kong Ng, Hong Kong (CN); Ming-Yao Chiang, Checheng Township, Pingtung County (CN)

( * ) Notice: Subject to any disclaimer, the term of this patent is extended or adjusted under 35 U.S.C. 154(b) by 137 days.

(21) Appl. No.: 13/861,484

(22) Filed: Apr. 12, 2013

(65) Prior Publication Data

US 2014/0307428 A1 Oct. 16, 2014

(51) Int. Cl.
*F21V 35/00* (2006.01)
*F21L 27/00* (2006.01)

(52) U.S. Cl.
CPC ..... *F21L 27/00* (2013.01)
USPC ..... 362/161; 362/447

(58) Field of Classification Search
CPC ..... F21S 6/001; F21S 10/04
USPC ..... 362/161, 392, 447, 810, 569
See application file for complete search history.

(56) References Cited

U.S. PATENT DOCUMENTS

2005/0276040 A1* 12/2005 Dennis et al. ..... 362/161
2010/0290238 A1* 11/2010 Howard ..... 362/392
2013/0039046 A1* 2/2013 Uzan ..... 362/183

* cited by examiner

*Primary Examiner* — Even Dzierzynski
(74) *Attorney, Agent, or Firm* — The Weintraub Group, P.L.C.

(57) ABSTRACT

A candle holder with candle light activated illumination has a base and a candle seat mounted on the base. A circuit board and an optical controller are mounted on the base. A driver and an LED lamp set are mounted on the circuit board. The optical controller activates the circuit board after sensing candle light. The candle seat is located above the circuit board, and has a light guide strip being inverted L-shaped with one end thereof radially exposed from an inner wall adjacent to a top opening of the candle seat and the other end downwardly extending into the candle seat and having a cap connected with the optical controller. Given the foregoing structure, melting wax of the candle cannot easily flow into the candle seat through the light guide strip to damage the circuit board.

53 Claims, 10 Drawing Sheets

CANDLE HOLDER WITH CANDLE LIGHT ACTIVATED ILLUMINATION

BACKGROUND OF THE INVENTION

1. Field of the Invention

The present invention relates to a candle holder, and more particularly to an electronic candle holder with candle light activated illumination.

2. Description of the Related Art

Candles used to be a popular lighting tool in the past. To securely mount candles, candle holders were invented. However, after the invention of electric lamps, candles are no longer the primary lighting tool of human beings but are used to add a romantic atmosphere in collaboration with candle holders. To increase the variety of candle holders, a candle holder with candle light activated illumination is invented.

With reference to FIGS. 7 to 9, a conventional candle holder with candle light activated illumination has a base 80, a circuit board 90, a display sheet 100, a candle seat 110, and a housing 120. The base 80 is a board with a central portion rising up to form a battery chamber 81. The circuit board 90 is mounted on a top of the rising portion, and has an optical controller 91 and a lamp set 92 mounted thereon. The display sheet 100 is light-transmissive and is mounted around the base 80 to form a tubular layer. A fixing ring 101 is mounted around a periphery of the display sheet 100 and is securely mounted on the base 80. The display sheet 100 has a pattern layer 102 formed on a surface of the display sheet 100. The candle seat 110 is mounted to a top opening of the tubular layer, and only a tailor-made candle 111 can be placed in the candle seat 110 such that the candle holder with candle light activated illumination is only good for one-time operation. The so-called tailor-made candle 111 has a candle wick 112 mounted through a bottom of the candle seat 110. After a light guide strip 113 is mounted in the candle wick 112, the candle wick 112 and the light guide strip 113 are fixed by filling candle wax. An opaque shield 114 covers an exposed portion of the candle wick 112 mounted through the bottom of the candle seat 110 and the optical controller 91 on the circuit board 90 for one end of the light guide strip 113 to be adjacent to the optical controller 91. The housing takes the form of a hollow cylinder and encloses the foregoing elements therein.

With reference to FIG. 10, when users light the candle wick 112, candle light is propagated to the shield 114 through the light guide strip 113 mounted in the candle wick 112, and shines on the optical controller 91 on the circuit board 90 to light the lamp set 92. The resultant light emitted from the lamp set 92 passes through the pattern layer 102 on the display sheet 100 to exhibit a corresponding light and shadow effect to increase visual appeal. However, the circuit board 90 is damage-prone as the melting wax easily flows to the circuit board 90 through the portion of the bottom of the candle seat 110 mounted through by the candle wick 112.

SUMMARY OF THE INVENTION

An objective of the present invention is to provide a candle holder with candle light activated illumination to prevent the melting wax of the candle from flowing into the candle holder and damaging a circuit board in the candle holder.

To achieve the foregoing objective, the candle holder with candle light activated illumination has a base, a circuit board, an optical controller, and a candle seat.

The base has a battery box.

The circuit board is mounted on the base and has a driver and a light-emitting diode (LED) lamp set.

The optical controller is mounted on the base and drives the circuit board to operate after sensing candle light.

The candle seat is mounted on the base and has an opening, a light guide strip, and an inner display sheet.

The opening is formed through one end of the candle seat.

The light guide strip is inverted L-shaped and is formed inside the candle seat. One end of the light guide strip is exposed from an inner portion of the candle seat adjacent to the opening of the candle seat, and the other end of the light guide strip downwardly extends into the candle seat and has a cap mounted thereon to cover the optical controller on the fixing plate.

The inner display sheet is mounted around an outer periphery of the candle seat and the circuit board, and is transparent.

The advantage of the present invention resides in that one end of the light guide strip radially extends beyond an inner wall of the candle seat and is adjacent to a top opening of the candle seat. Accordingly, the melting wax of the candle cannot easily flow into the candle seat through the light guide strip and would not cause damage to the circuit board. Also because the light guide strip is mounted inside the candle seat, operational convenience can be enhanced since regular candles are adequate for lighting to achieve a desired optical control effect through the light guide strip without requiring the use of tailor-made candles.

Other objectives, advantages and novel features of the invention will become more apparent from the following detailed description when taken in conjunction with the accompanying drawings.

DETAILED DESCRIPTION OF THE INVENTION

Figure 1:
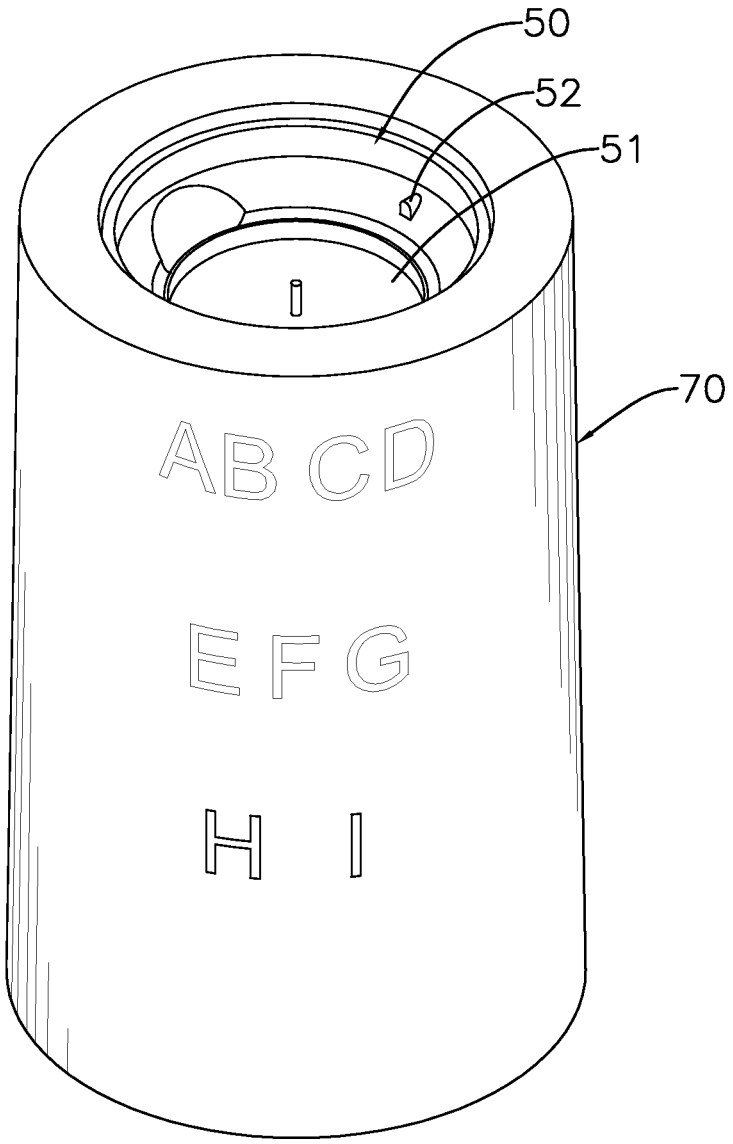
FIG. 1 is a perspective view of a candle holder with candle light activated illumination in accordance with the present invention.
Figure 2:
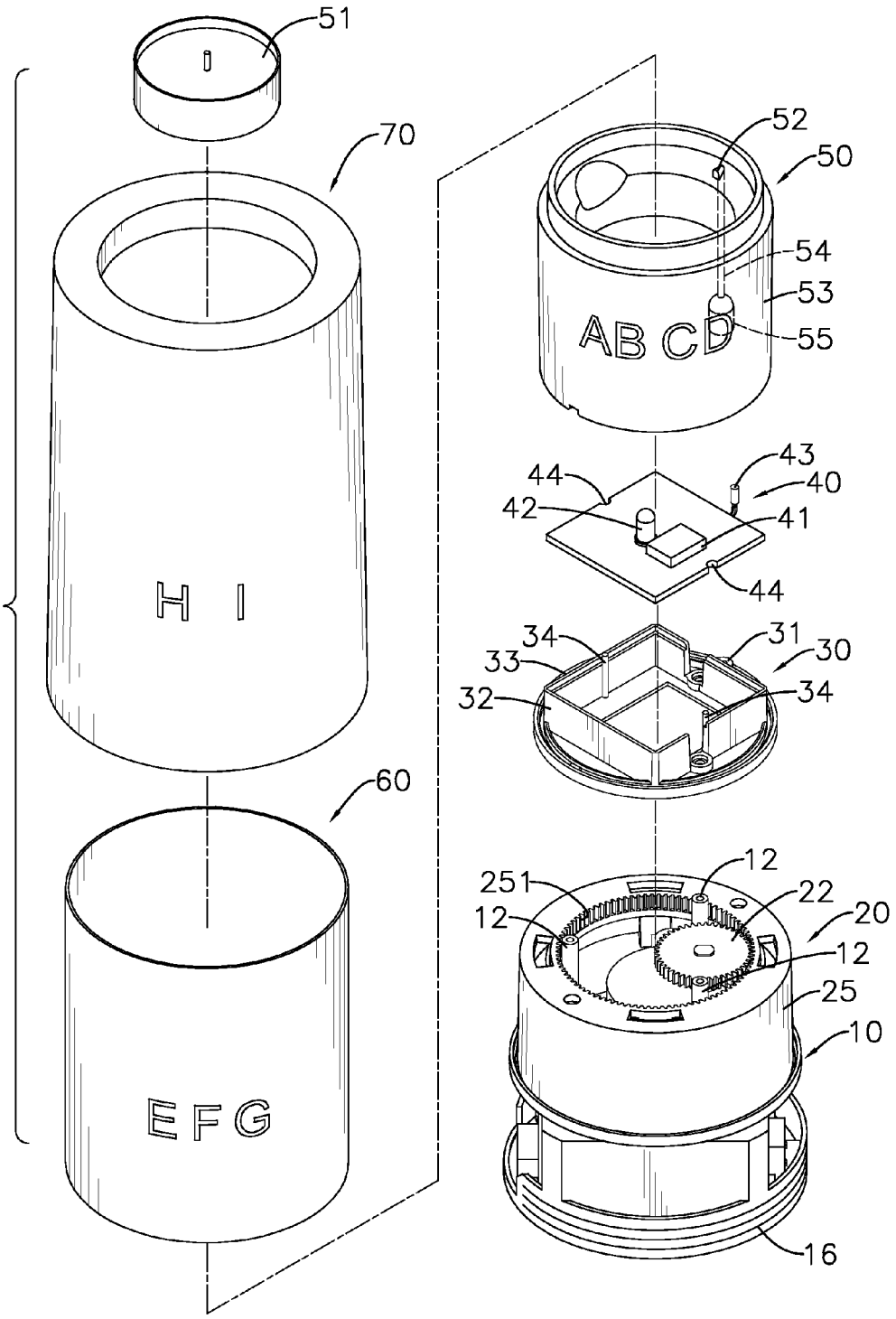
FIG. 2 is an exploded perspective view of the candle holder in FIG. 1.

With reference to FIGS. 1 and 2, a candle holder with candle light activated illumination in accordance with the present invention has a base 10, a driving assembly 20, a fixing plate 30, a circuit board 40, a candle seat 50, an outer display sheet 60, and a housing 70.

Figure 3:
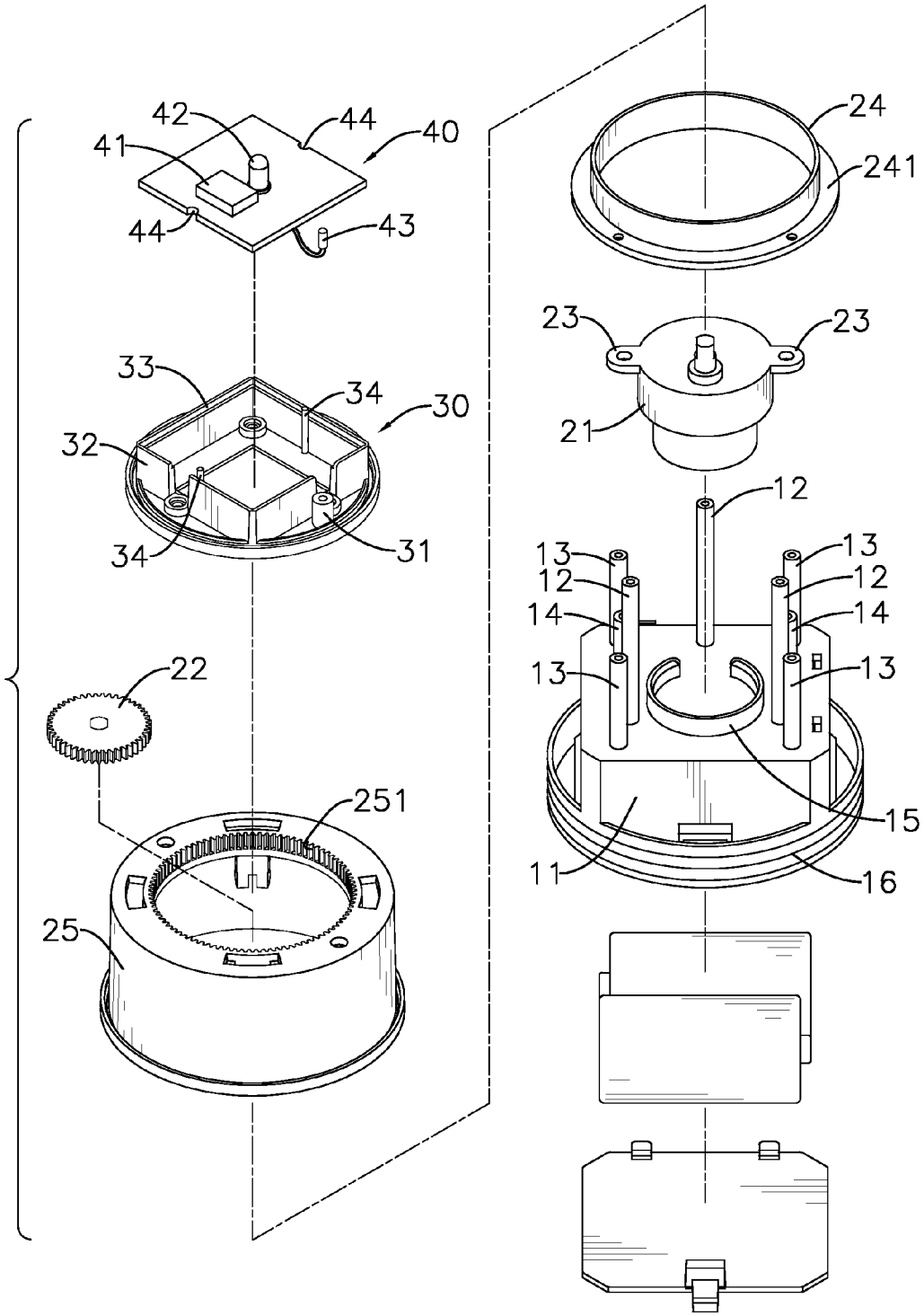
FIG. 3 is another exploded perspective view of the candle holder in FIG. 1.

With reference to FIGS. 2 and 3, the base 10 has a battery box 11, a battery lid, at least one electronic fixing rod 12, multiple rotation fixing rods 13, at least one motor fixing rod 14, a fixing ring 15, and an outer thread 16. The battery lid is mounted on a bottom portion of the battery box 11. The at least one electronic fixing rod 12, the rotation fixing rods 13, the at least one motor fixing rod 14, and the fixing ring 15 are mounted on a top surface of the battery box 11. The at least one electronic fixing rod 12 is relatively taller than the rotation fixing rods 13. The rotation fixing rods 13 are relatively taller than the at least one motor fixing rod 14. The outer thread 16 is formed on an outer periphery of the base 10.

Figure 4:
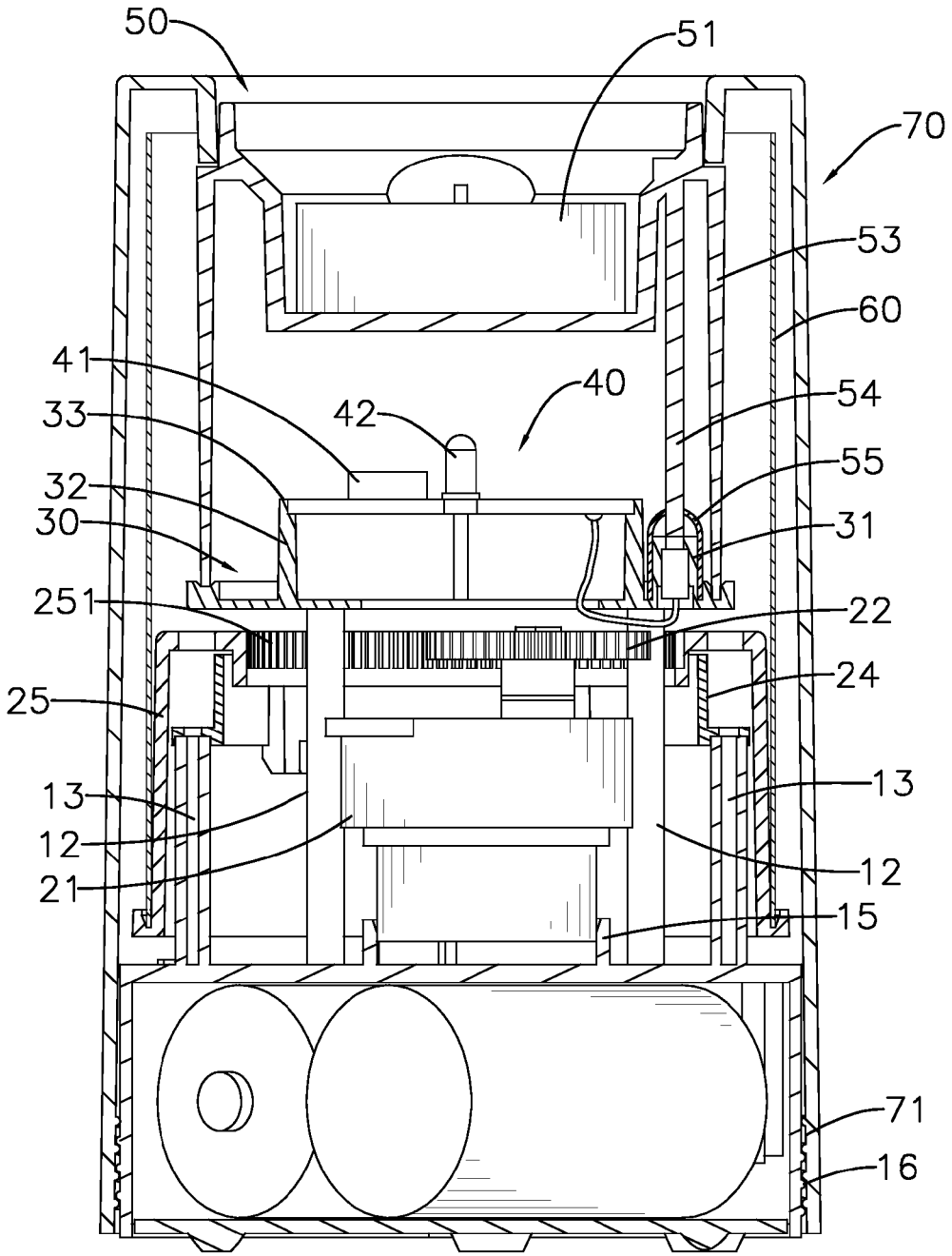
FIG. 4 is a side view in partial section of the candle holder in FIG. 1.
Figure 5:
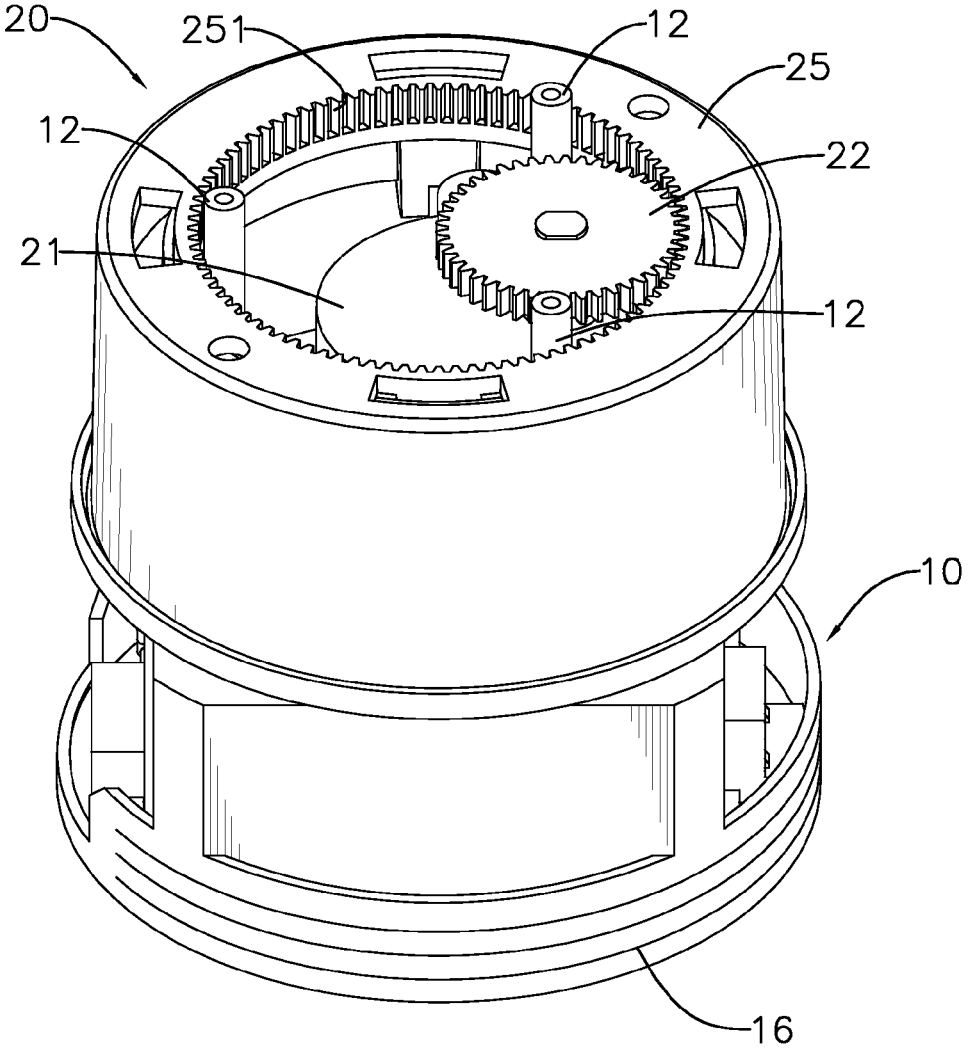
FIG. 5 is a perspective view of a driving assembly of the candle holder in FIG. 1.

With reference to FIGS. 3 to 5, the driving assembly 20 is mounted on the top surface of the base 10, and has a motor 21, a rotation fixing seat 24, and an annular gear 25. The motor 21 is mounted on the top surface of the battery box 11 and located within the fixing ring 15. The motor 21 may be a gear reducer motor. The motor 21 has a driving gear 22 and at least one fixing lug 23. The driving gear 22 is mounted on the motor 21. The at least one fixing lug 23 is formed on a side edge of the motor 21 to correspond to the at least one motor fixing rod 14, and is mounted through by the at least one motor fixing rod 14 respectively. The rotation fixing seat 24 is ring-shaped and has an annular flange 241 formed on and radially protruding from a bottom edge of the rotation fixing seat 24, and mounted on top ends of the rotation fixing rods 13 for the rotation fixing seat 24 to be located above the base 10. The annular gear 25 is mounted around the rotation fixing seat 24 and is spaced apart from the rotation fixing seat 24 by a gap. The annular gear 25 has inner teeth 251 formed on an inner wall of the annular gear 25 to correspond to and engage the driving gear 22.

With reference to FIGS. 2 to 4, the fixing plate 30 is mounted on at least one top end of the at least one electronic fixing rod 12, is located above the driving assembly 20, and has an optical controller 31, a fixing wall 32, and two positioning rods 34. The fixing wall 32 is formed on and protrudes upwards from a top of the fixing plate 30, and has a recessed edge 33 formed in a top surface of the fixing wall 32. The two positioning rods 34 are oppositely formed on an inner surface of the fixing wall 32 of the fixing plate 30.

The circuit board 40 is mounted on the fixing wall 32 with a perimetric edge abutting against the recessed edge 33 of the fixing plate 30, and has a driver 41, a light-emitting diode (LED) lamp set 42, and an electric wire 43. The electric wire 43 is electrically connected with the optical controller 31 on the fixing plate 30. When sensing light, the optical controller 31 drives the circuit board 40 to operate. The circuit board 40 further has two indentations 44 oppositely formed in the perimetric edge of the circuit board 40 to correspond to the two positioning rods 34 for the circuit board 40 to be held by the positioning rods 34.

With reference to FIGS. 1, 2 and 4, the candle seat 50 is securely mounted on the fixing plate 30 for mounting a candle 51 in the candle seat 50. The candle seat 50 has a top chamber, a bottom chamber, a bevel wall, an inner display sheet 53, and a light guide strip 54. The top chamber and the bottom chamber are separated by a partition wall, and each of the top chamber and the bottom chamber has an opening. The bevel wall is formed on the partition wall and is adjacent to the opening of the top chamber, and has a light guide hole 52 that is inverted L-shaped and is first radially formed in the bevel wall and further downwardly formed through the bevel wall. The inner display sheet 53 is mounted on an outer periphery of the candle seat 50, is transparent, and has a pattern layer formed on the inner display sheet 53. The light guide strip 54 is inverted L-shaped. One end of the light guide strip 54 radially penetrates through the light guide hole 52 on the bevel wall of the candle seat 50, and the other end of the light guide strip 54 downwardly extends into the bottom chamber and has a cap 55 mounted thereon to cover the optical controller 31 on the fixing plate 30. When the candle 51 is lit, a part of the candle light is irradiated to the bevel wall of the candle seat 50 and is further transmitted to the optical controller 31 inside the cap 55 through the light guide strip 54.

The outer display sheet 60 is tubular, is mounted on the driving assembly 20 and surrounds the driving assembly 20, the fixing plate 30, and the candle seat 50 with the candle seat 50 exposed from an opening of the outer display sheet 60. The outer display sheet 60 is rotated along with the driving assembly 20, is transparent, and has a pattern layer formed on the outer display sheet 60.

Figure 6:
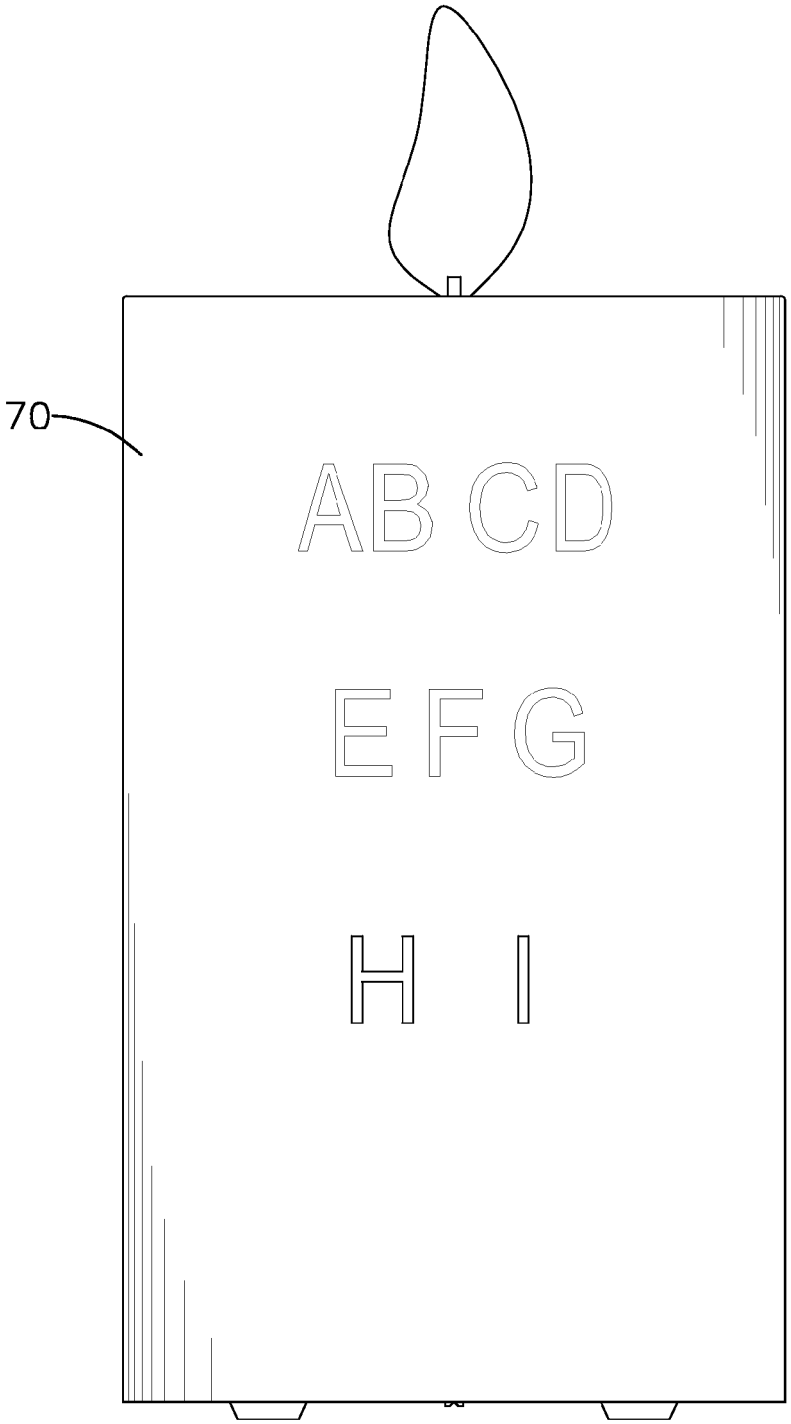
FIG. 6 is an operational side view of the candle holder in FIG. 1.
Figure 7:
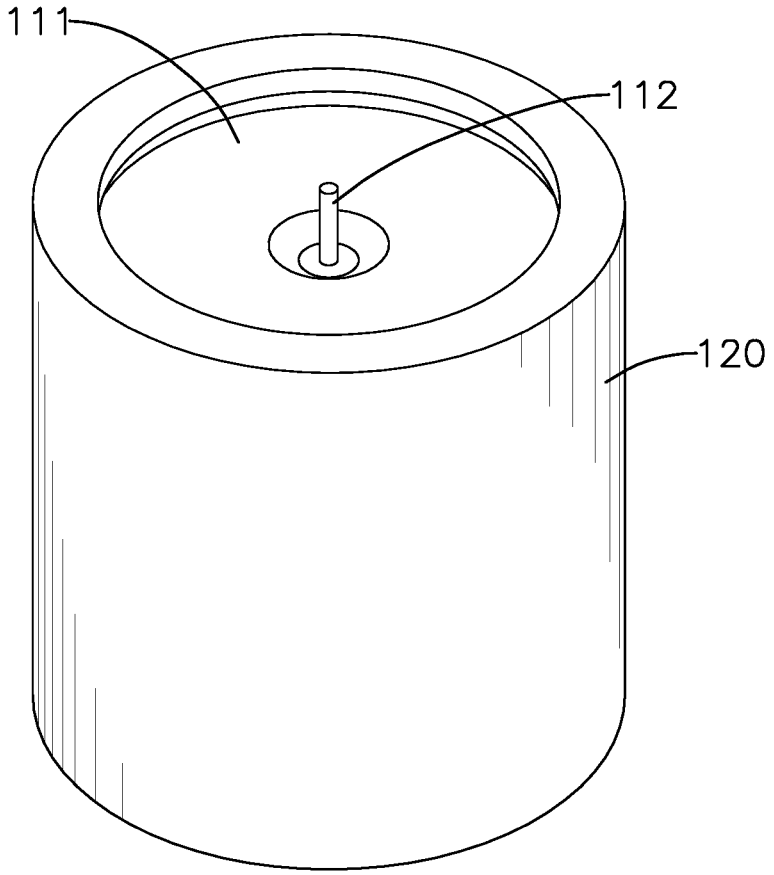
FIG.7 PRIOR ART
FIG. 7 is a conventional candle holder with candle light activated illumination.
Figure 8:
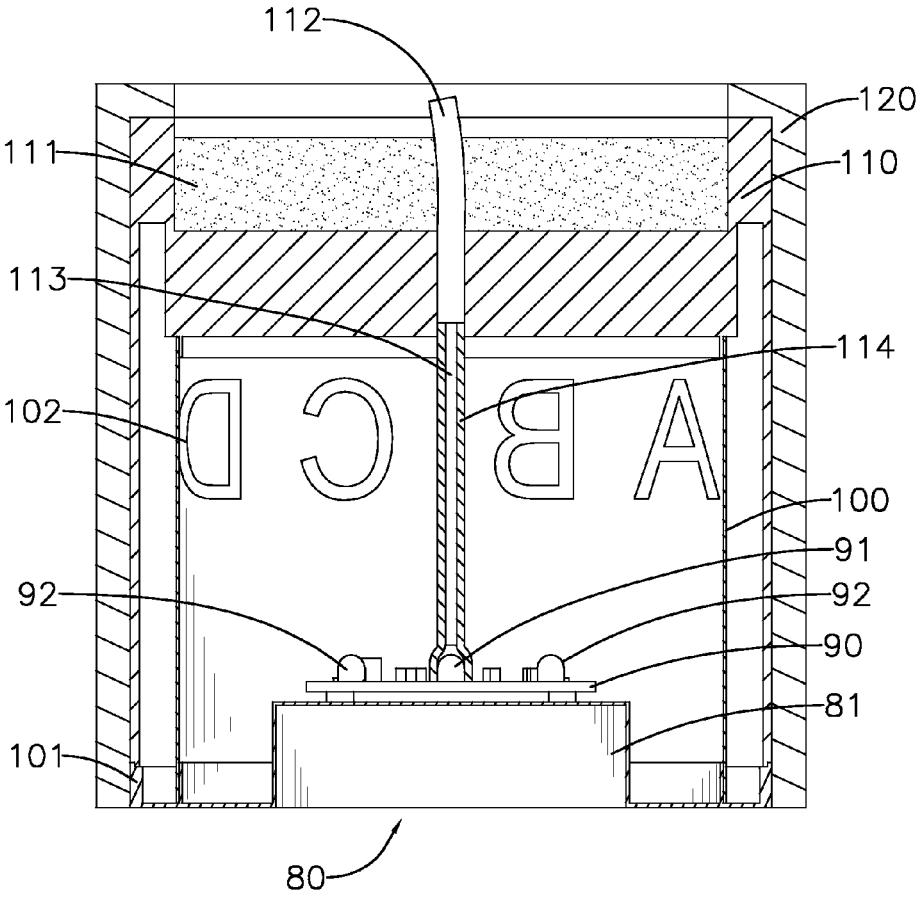
FIG.8 PRIOR ART
FIG. 8 is a side view in partial section of the candle holder in FIG. 7.
Figure 9:
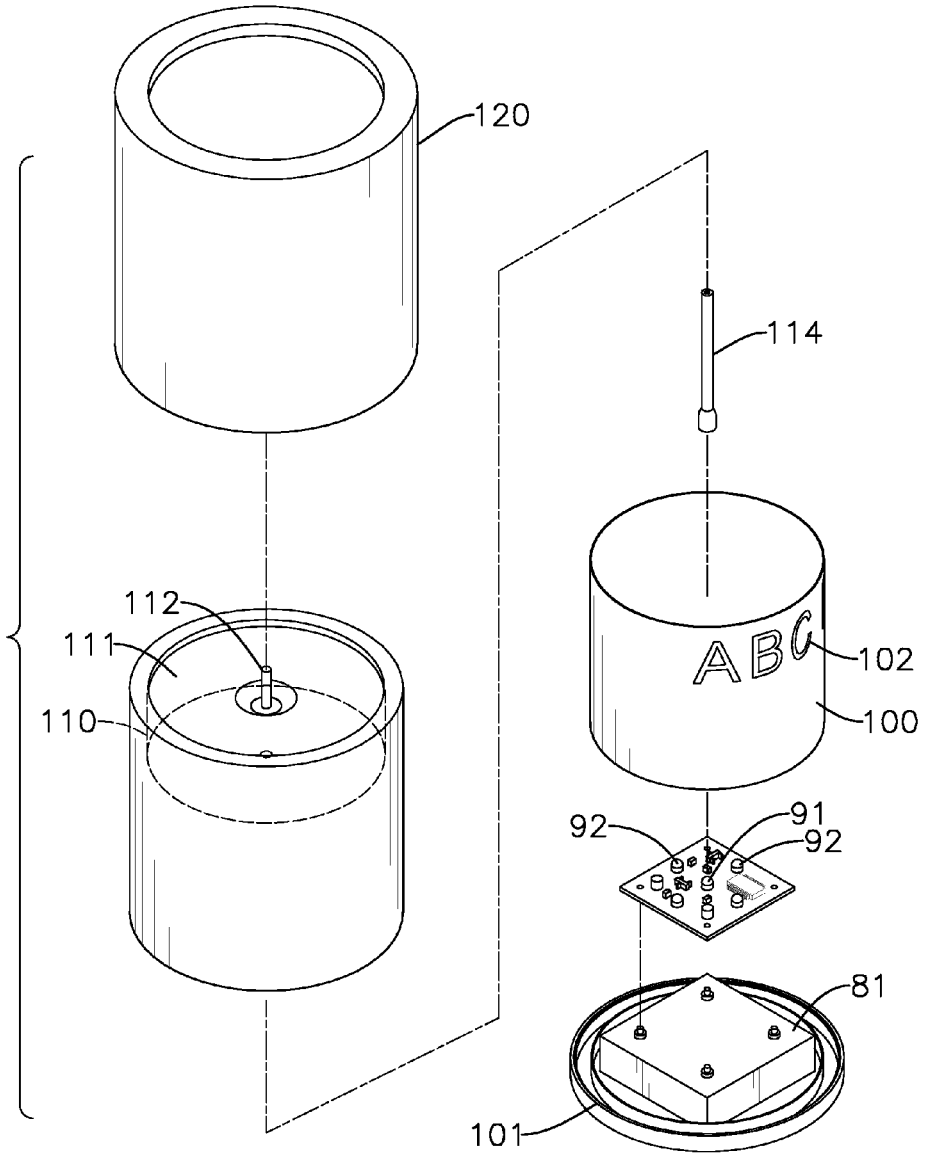
FIG.9 PRIOR ART
FIG. 9 is an exploded perspective view of the candle holder in FIG. 7.
Figure 10:
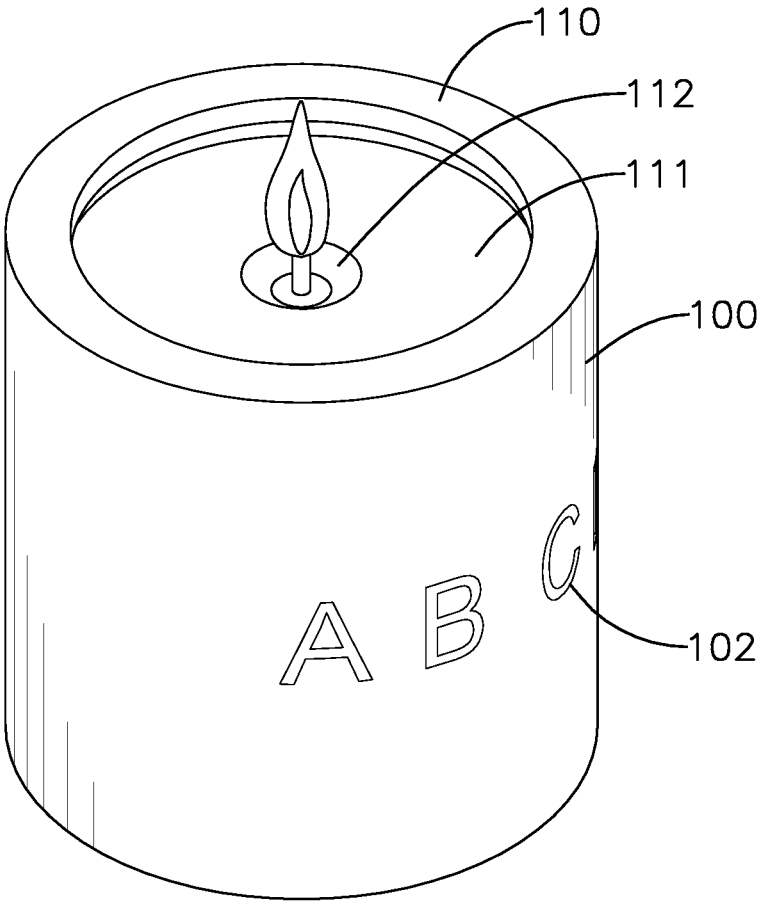
FIG.10 PRIOR ART
FIG. 10 is an operational perspective view of the candle holder in FIG. 7.

With reference to FIG. 6, the housing 70 is transparent and tubular, and has a pattern layer formed on the housing 70. The housing 70 is mounted around the base 10 and the outer display sheet 60, and has an inner thread 71 mounted on an inner bottom portion of the housing 70 and being adjacent to a bottom opening of the housing 70 to correspond to the outer thread 16 for the inner thread 71 on the housing 70 to engage the outer thread 16 on the base 10. The housing 70 further has a top opening for the candle seat 50 to be exposed from the top opening From the foregoing, as one end of the light guide strip 54 radially extends into the candle seat 50 and is adjacent to the candle 51, the light guide strip 54 can be avoided transmitting natural light. When the wick of the candle 51 is lit, the light guide strip 54 transmits candle light to the cap 55. As the light guide hole 52 is radially formed in the bevel wall of the candle seat 50, melting wax of the candle 51 cannot easily flow into the light guide hole 52 to damage the circuit board through the light guide strip 54. Also because the light guide strip 54 is directly formed in the candle seat 50, regular candles are adequate for lighting to achieve a desired optical control effect through the light guide strip 54 without requiring the use of any tailor-made candle. Moreover, after sensing the candle light, the optical controller 31 surrounded by the cap 55 drives the driver 41 on the circuit board 40 to start operating the motor 21 and the LED lamp set 42. The motor 21 drives the driving gear 22 to rotate, the driving gear 22 drives the annular gear 25 engaging with the driving gear 22, and the annular gear 25 drives the outer display sheet 60 to rotate. The light emitted by the LED lamp set 42 generates different light and shadow effects through the inner display sheet 53 of the candle seat 50 and the outer display sheet 60 rotated along with the driving assembly 20 to enhance the visual appeal of the present invention.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A candle holder with candle light activated illumination, comprising:

a base having a battery box;

a circuit board mounted on the base and having a driver and a light-emitting diode (LED) lamp set;

an optical controller mounted on the base and driving the circuit board to operate after sensing candle light; and a candle seat mounted on the base and having:

an opening formed through one end of the candle seat;

a light guide strip being inverted L-shaped and formed inside the candle seat, wherein one end of the light guide strip is exposed from an inner portion of the candle seat adjacent to the opening of the candle seat, and the other end of the light guide strip downwardly extends into the candle seat and has a cap mounted on the other end of the light guide strip to cover the optical controller on the fixing plate; and an inner display sheet mounted around an outer periphery of the candle seat and the circuit board, and being transparent.

2. The candle holder as claimed in claim 1, further comprising a driving assembly mounted on the base, wherein the circuit board is mounted on the driving assembly, and an outer display sheet is transparent, is mounted around the inner display sheet, and is securely mounted on the driving assembly.

3. The candle holder as claimed in claim 2, wherein the driving assembly has:

a motor has a driving gear mounted on the base;

a rotation fixing seat being ring-shaped, mounted on the base, and having an annular flange formed on and radially protruding from a bottom edge of the rotation fixing seat; and an annular gear mounted around the rotation fixing seat, spaced apart from the rotation fixing seat by a gap, and having inner teeth formed on an inner wall of the annular gear to correspond to and engage the driving gear.

4. The candle holder as claimed in claim 3 further comprising a fixing plate mounted on the driving assembly, and having a fixing wall formed on and protruding upwards from a top of the fixing plate, wherein the circuit board is mounted on the fixing wall, the candle seat is mounted on the fixing plate, and the inner display sheet is securely mounted on the fixing plate.

5. The candle holder as claimed in claim 4, wherein the base has:

at least one electronic fixing rod mounted on the base, and mounted through the rotation fixing seat and the annular gear to support the fixing plate and position the fixing plate above the driving assembly;

multiple rotation fixing rods mounted on the base to support the rotation fixing seat and position the rotation fixing seat above the base, and being relatively shorter than the at least one electronic fixing rod; and at least one motor fixing rod mounted on the base to support the motor , and being relatively shorter than the rotation fixing rods.

6. The candle holder as claimed in claim 5, wherein the motor has at least one fixing lug formed on a side edge of the motor to correspond to the at least one motor fixing rod, and respectively mounted through by the at least one motor fixing rod.

7. The candle holder as claimed in claim 2, wherein the inner display sheet has a pattern layer formed on the inner display sheet.

8. The candle holder as claimed in claim 2, further comprising a housing being tubular, mounted around the base and the outer display sheet, and having a top opening for the candle seat to be exposed from the top opening.

9. The candle holder as claimed in claim 8, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage with the outer thread on the base.

10. The candle holder as claimed in claim 8, wherein the housing is transparent and has a pattern layer formed on the housing.

11. The candle holder as claimed in claim 3, wherein the inner display sheet has a pattern layer formed on the inner display sheet.

12. The candle holder as claimed in claim 3, further comprising a housing being tubular, mounted around the base and the outer display sheet, and having a top opening for the candle seat to be exposed from the top opening.

13. The candle holder as claimed in claim 12, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage with the outer thread on the base.

14. The candle holder as claimed in claim 12, wherein the housing is transparent and has a pattern layer formed on the housing.

15. The candle holder as claimed in claim 3, wherein the motor is a gear reducer motor.

16. The candle holder as claimed in claim 4, wherein the inner display sheet has a pattern layer formed on the inner display sheet, and the outer display sheet has a pattern layer formed on the outer display sheet.

17. The candle holder as claimed in claim 16, wherein the fixing plate further has at least one positioning rod formed on an inner wall of the fixing wall of the fixing plate, and the circuit board further has at least one indentation formed in a perimetric edge of the circuit board to respectively correspond to the at least one positioning rod.

18. The candle holder as claimed in claim 17, further comprising a housing being tubular, mounted around the base and the outer display sheet, and having a top opening for the candle seat to be exposed from the top opening.

19. The candle holder as claimed in claim 18, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage the outer thread on the base.

20. The candle holder as claimed in claim 19, wherein the housing is transparent and has a pattern layer formed on the housing.

21. The candle holder as claimed in claim 20, wherein the fixing wall of the fixing plate has a recessed edge formed in a top surface of the fixing wall, and the circuit board is mounted on the fixing wall with the perimetric edge of the circuit board abutting against the recessed edge of the fixing plate.

22. The candle holder as claimed in claim 4, wherein the fixing plate further has at least one positioning rod formed on an inner wall of the fixing wall of the fixing plate, and the circuit board further has at least one indentation formed in a perimetric edge of the circuit board to respectively correspond to the at least one positioning rod.

23. The candle holder as claimed in claim 22, wherein the fixing wall of the fixing plate has a recessed edge formed in a top surface of the fixing wall, and the circuit board is mounted on the fixing wall with the perimetric edge of the circuit board abutting against the recessed edge of the fixing plate.

24. The candle holder as claimed in claim 4, further comprising a housing being tubular, mounted around the base and the outer display sheet, and having a top opening for the candle seat to be exposed from the top opening.

25. The candle holder as claimed in claim 24, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage with the outer thread on the base.

26. The candle holder as claimed in claim 24, wherein the housing is transparent and has a pattern layer formed on the housing.

27. The candle holder as claimed in claim 4, wherein the motor is a gear reducer motor.

28. The candle holder as claimed in claim 5, wherein the inner display sheet has a pattern layer formed on the inner display sheet, and the outer display sheet has a pattern layer formed on the outer display sheet.

29. The candle holder as claimed in claim 28, wherein the fixing plate further has at least one positioning rod formed on an inner wall of the fixing wall of the fixing plate, and the circuit board further has at least one indentation formed in a perimetric edge of the circuit board to respectively correspond to the at least one positioning rod.

30. The candle holder as claimed in claim 29, further comprising a housing being tubular, mounted around the base and the outer display sheet, and having a top opening for the candle seat to be exposed from the top opening.

31. The candle holder as claimed in claim 30, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage the outer thread on the base.

32. The candle holder as claimed in claim 31, wherein the housing is transparent and has a pattern layer formed on the housing.

33. The candle holder as claimed in claim 32, wherein the fixing wall of the fixing plate has a recessed edge formed in a top surface of the fixing wall, and the circuit board is mounted on the fixing wall with the perimetric edge of the circuit board abutting against the recessed edge of the fixing plate.

34. The candle holder as claimed in claim 5, wherein the fixing plate further has at least one positioning rod formed on an inner wall of the fixing wall of the fixing plate, and the circuit board further has at least one indentation formed in a perimetric edge of the circuit board to respectively correspond to the at least one positioning rod.

35. The candle holder as claimed in claim 34, wherein the fixing wall of the fixing plate has a recessed edge formed in a top surface of the fixing wall, and the circuit board is mounted on the fixing wall with the perimetric edge of the circuit board abutting against the recessed edge of the fixing plate.

36. The candle holder as claimed in claim 5, further comprising a housing being tubular, mounted around the base and the outer display sheet, and having a top opening for the candle seat to be exposed from the top opening.

37. The candle holder as claimed in claim 36, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage with the outer thread on the base.

38. The candle holder as claimed in claim 36, wherein the housing is transparent and has a pattern layer formed on the housing.

39. The candle holder as claimed in claim 5, wherein the motor is a gear reducer motor.

40. The candle holder as claimed in claim 6, wherein the inner display sheet has a pattern layer formed on the inner display sheet, and the outer display sheet has a pattern layer formed on the outer display sheet.

41. The candle holder as claimed in claim 40, wherein the fixing plate further has at least one positioning rod formed on an inner wall of the fixing wall of the fixing plate, and the circuit board further has at least one indentation formed in a perimetric edge of the circuit board to respectively correspond to the at least one positioning rod.

42. The candle holder as claimed in claim 41, further comprising a housing being tubular, mounted around the base and the outer display sheet, and having a top opening for the candle seat to be exposed from the top opening.

43. The candle holder as claimed in claim 42, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage the outer thread on the base.

44. The candle holder as claimed in claim 43, wherein the housing is transparent and has a pattern layer formed on the housing.

45. The candle holder as claimed in claim 44, wherein the fixing wall of the fixing plate has a recessed edge formed in a top surface of the fixing wall, and the circuit board is mounted on the fixing wall with the perimetric edge of the circuit board abutting against the recessed edge of the fixing plate.

46. The candle holder as claimed in claim 6, wherein the fixing plate further has at least one positioning rod formed on an inner wall of the fixing wall of the fixing plate, and the circuit board further has at least one indentation formed in a perimetric edge of the circuit board to respectively correspond to the at least one positioning rod.

47. The candle holder as claimed in claim 46, wherein the fixing wall of the fixing plate has a recessed edge formed in a top surface of the fixing wall, and the circuit board is mounted on the fixing wall with the perimetric edge of the circuit board abutting against the recessed edge of the fixing plate.

48. The candle holder as claimed in claim 6, further comprising a housing being tubular, mounted around the base and the outer display sheet, and having a top opening for the candle seat to be exposed from the top opening.

49. The candle holder as claimed in claim 48, wherein the base has an outer thread formed on an outer periphery of the base, and the housing has an inner thread mounted on an inner portion of the housing and being adjacent to a bottom opening of the housing to correspond to the outer thread of the base for the inner thread on the housing to engage with the outer thread on the base.

50. The candle holder as claimed in claim 48, wherein the housing is transparent and has a pattern layer formed on the housing.

51. The candle holder as claimed in claim 6, wherein the motor is a gear reducer motor.

52. The candle holder as claimed in claim 1, wherein the inner display sheet has a pattern layer formed on the inner display sheet.

53. The candle holder as claimed in claim 1 further comprising a housing being tubular, mounted around the base and the outer display sheet, and having a top opening for the candle seat to be exposed from the top opening.

* * * * *